US011571077B1

(12) United States Patent
Solis

(10) Patent No.: US 11,571,077 B1
(45) Date of Patent: Feb. 7, 2023

(54) HAMBURGER HOLDER

(71) Applicant: John Solis, Abilene, TX (US)

(72) Inventor: John Solis, Abilene, TX (US)

( * ) Notice: Subject to any disclaimer, the term of this patent is extended or adjusted under 35 U.S.C. 154(b) by 773 days.

(21) Appl. No.: 16/595,614

(22) Filed: Oct. 8, 2019

(51) Int. Cl.
*A47G 21/00* (2006.01)
*A47G 19/30* (2006.01)

(52) U.S. Cl.
CPC ..... *A47G 21/001* (2013.01); *A47G 19/30* (2013.01)

(58) Field of Classification Search
CPC ..... A47G 2019/306; A47G 2400/06; A47G 2021/002; A47G 23/06; B65D 11/188; A47J 43/00
USPC ..... 229/938, 902, 906, 107; 426/396, 411; 206/525, 804; 220/737; 222/391; 248/311.2; D1/105; D7/602
See application file for complete search history.

(56) References Cited

U.S. PATENT DOCUMENTS 3,355,082 A * 11/1967 Wood ..... A47G 21/001 426/115
3,481,458 A 12/1969 Mayeaux
3,727,802 A * 4/1973 Schnurmacher ..... A47G 21/08 222/386
4,189,054 A 2/1980 Liu
5,632,379 A * 5/1997 Frost ..... A47G 21/001 206/541
5,833,382 A * 11/1998 Jenks ..... A45D 40/02 401/262
5,860,587 A 1/1999 Young
6,779,664 B1 8/2004 Bermann
8,459,531 B2 * 6/2013 D'Amato ..... B65D 5/029 229/110
8,596,457 B1 12/2013 Goblirsch
D756,216 S 5/2016 El-Debs
2014/0261095 A1 * 9/2014 Shendelman ..... A47G 23/0625 294/24

FOREIGN PATENT DOCUMENTS

KR 20150026668 A * 3/2015
WO 9606781 3/1996
WO WO-9606781 A1 * 3/1996 ..... A47G 21/001

* cited by examiner

*Primary Examiner* — Christopher R Demeree
(74) *Attorney, Agent, or Firm* — Kyle A. Fletcher, Esq.

(57) ABSTRACT

The hamburger holder comprised a main body, a lift, and a stand. The hamburger holder may hold a sandwich and may prevent condiments and toppings from falling out of the sandwich as the sandwich is eaten. The sandwich may be a hamburger, the condiments may be mustard, ketchup, mayonnaise, and barbecue sauce, and the toppings may be lettuce, tomato, pickles, bacon, cheese, and onions. The main body may hold the sandwich together while the sandwich is eaten. The left may push the sandwich out of the main body to expose more of the sandwich for consumption. The stand may be a base to allow the main body to stand freely when the main body is n not being held. The main body, the lift, and the stand may be decoupled from each other for cleaning.

18 Claims, 4 Drawing Sheets

HAMBURGER HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of food serving utensils, more specifically, a hamburger holder.

SUMMARY OF INVENTION

The hamburger holder comprised a main body, a lift, and a stand. The hamburger holder may hold a sandwich and may prevent condiments and toppings from falling out of the sandwich as the sandwich is eaten. As a non-limiting examples, the sandwich may be a hamburger, the condiments may be mustard, ketchup, mayonnaise, and barbecue sauce, and the toppings may be lettuce, tomato, pickles, bacon, cheese, and onions. The main body may hold the sandwich together while the sandwich is eaten. The left may push the sandwich out of the main body to expose more of the sandwich for consumption. The stand may be a base to allow the main body to stand freely when the main body is n not being held. The main body, the lift, and the stand may be decoupled from each other for cleaning.

An object of the invention is to hold a sandwich while the sandwich is eaten.

Another object of the invention is to prevent condiments and toppings from falling out of the sandwich.

A further object of the invention is to provide a lift to push the sandwich out of the main body such that more of the sandwich is exposed for consumption.

Yet another object of the invention is to provide a stand to hold the main body upright.

These together with additional objects, features and advantages of the hamburger holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the hamburger holder in detail, it is to be understood that the hamburger holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hamburger holder.

It is therefore important that the claims be regarded as including such equivalent construction insofar as they do not depart from the spirit and scope of the hamburger holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
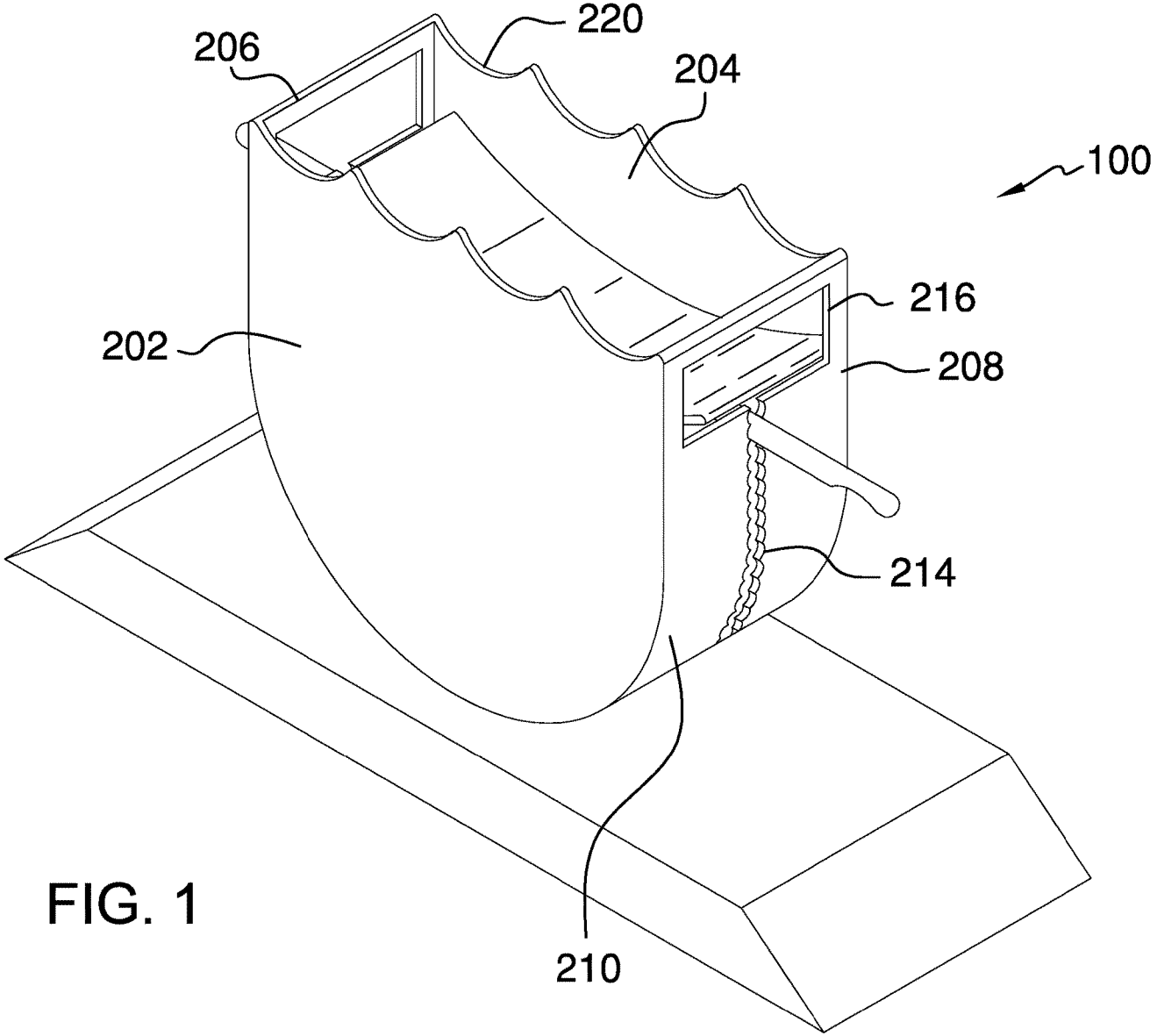
FIG. 1 is an isometric view of an embodiment of the disclosure.
Figure 2:
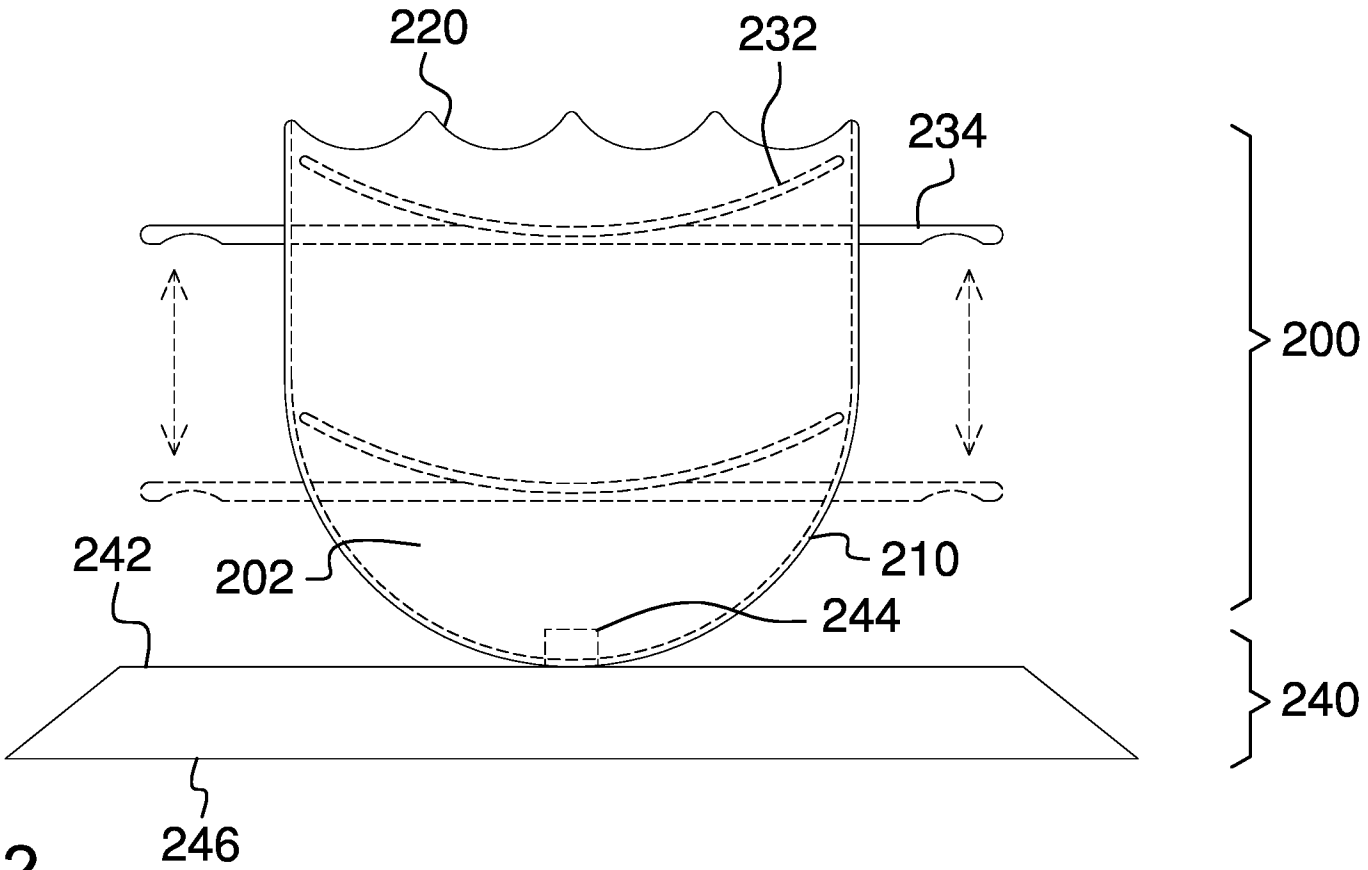
FIG. 2 is a front view of an embodiment of the disclosure.
Figure 4:
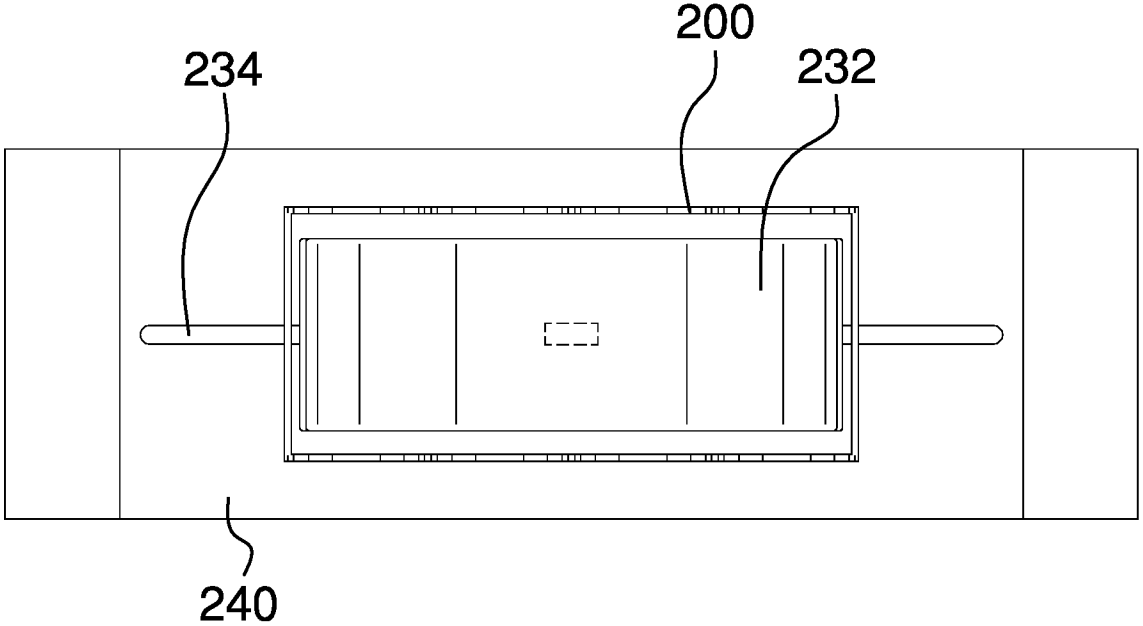
FIG. 4 is a top view of an embodiment of the disclosure.
Figure 3:
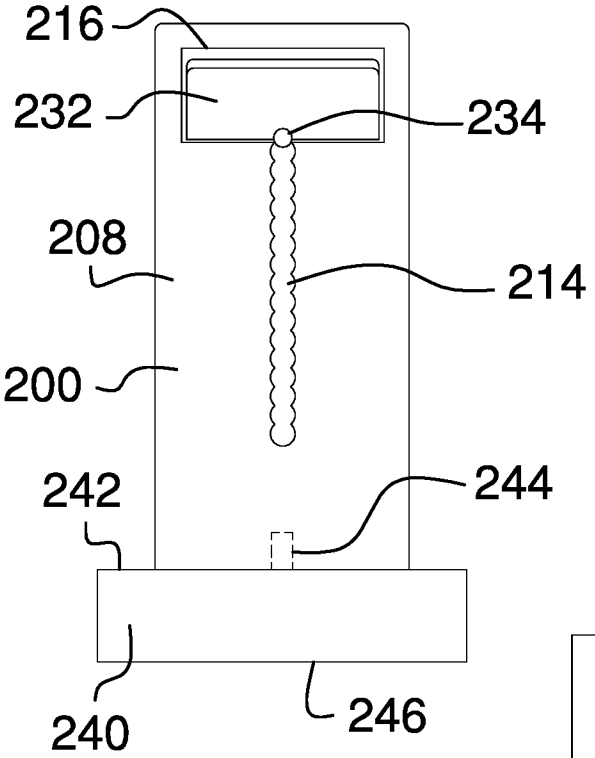
FIG. 3 is a side view of an embodiment of the disclosure.
Figure 5:
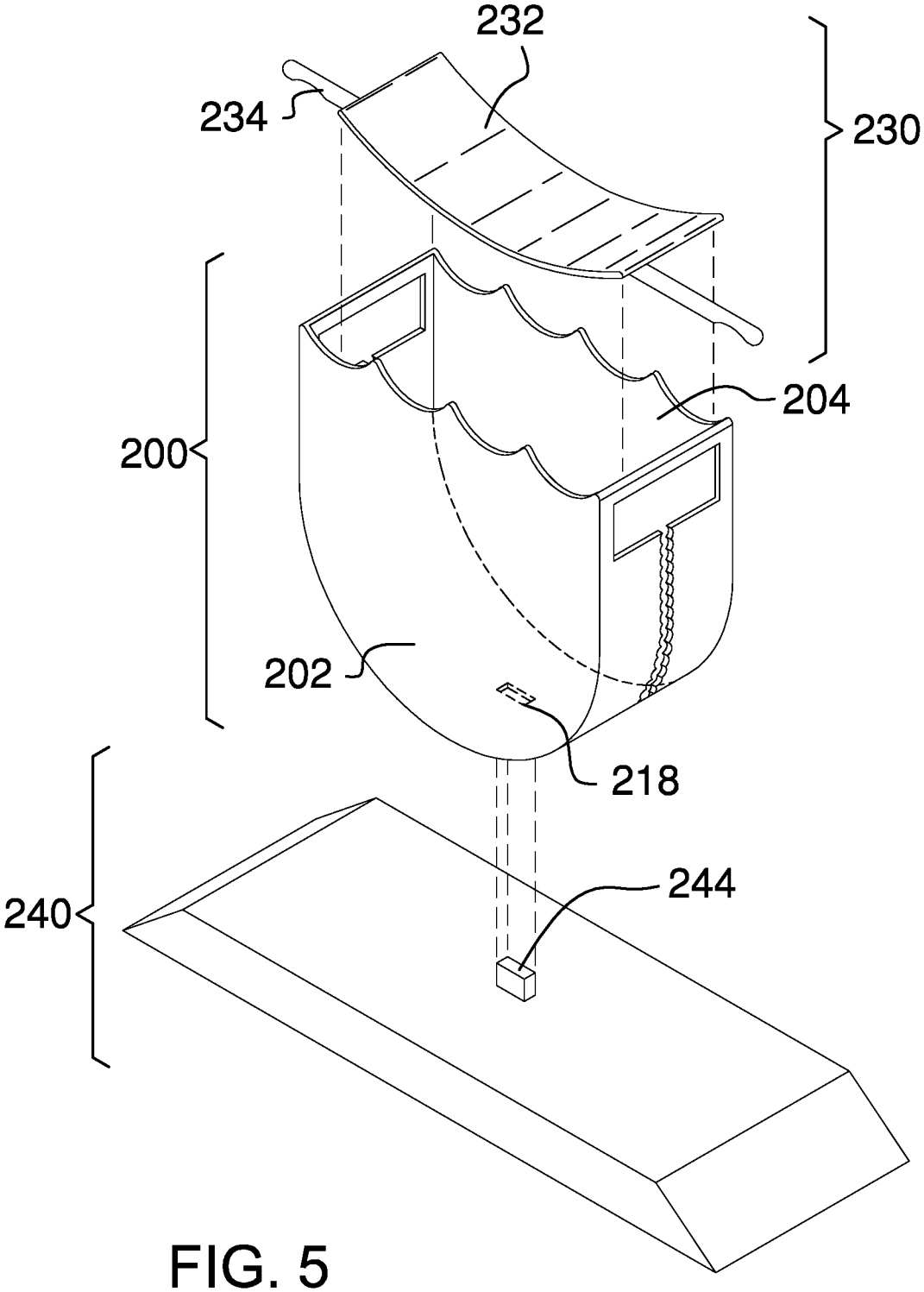
FIG. 5 is an exploded view of an embodiment of the disclosure.

Detailed reference will now be made to a first potential embodiment of the disclosure, which is illustrated in FIGS. 1 through 5.

The hamburger holder 100 (hereinafter invention) comprises a main body 200, a lift 230, and a stand 240. The invention 100 may hold a sandwich and may prevent condiments and toppings from falling out of the sandwich as the sandwich is eaten. As a non-limiting examples, the sandwich may be a hamburger, the condiments may be mustard, ketchup, mayonnaise, and barbecue sauce, and the toppings may be lettuce, tomato, pickles, bacon, cheese, and onions. The main body 200, the lift 230, and the stand 240 may be decoupled from each other for cleaning.

The main body 200 may comprise a front side 202, a rear side 204, and a bottom panel 210. The main body 200 may be an open-top container into which the sandwich may be placed. The front side 202 and the rear side 204 may apply pressure to the outer layers of the sandwich to prevent the sandwich from opening.

The front side 202 and the rear side 204 may be vertically oriented and parallel to each other. The bottom portion of the front side 202 and the rear side 204 may each be semicircular. The top portion of the front side 202 and the rear side 204 may have straight vertical edges that are parallel to each other. In some embodiments, the top edge of both the front side 202 and the rear side 204 may comprise a scalloped upper edge 220 to provide biting space.

The bottom panel 210 may be a rectangular panel that curves upwards on each end and couples to the front side 202 and to the rear side 204. The bottom panel 210 may be convex at the bottom exterior of the main body 200 and concave at the bottom interior of the main body 200 to conform to the shape of the front side 202 and the rear side 204. The bottom panel 210 may extend straight upwards to form a left side 206 and a right side 208 of the main body 200. The curved section of the bottom panel 210 may be coupled to the semicircular section of the front side 202 and the rear side 204. The left side 206 may be coupled to the left edge of the front side 202 and to the left edge of the rear side 204. The right side 208 may be coupled to the right edge of the front side 202 and to the right edge of the rear side 204.

An individual side selected from the left side 206 and the right side 208 may comprise a handle slot 214 and a removal aperture 216. A handle 234 of the lift 230 may pass through the handle slot 214. The handle slot 214 and the removal aperture 216 may be contiguous such that the handle 234 may be elevated from the handle slot 214 into the removal aperture 216. The lift 230 may be removed from the interior of the main body 200 by passing the lift 230 laterally through the removal aperture 216 when the lift 230 is elevated to align with the removal aperture 216.

The lift 230 may comprise a lifting surface 232 and the handle 234. The lift 230 may limit the distance into the main body 200 that the sandwich may be inserted. With the lift 230 lowered such that the handle 234 as located at the bottom of the handle slot 214 on both the left side 206 and the right side 208, the sandwich may be maximally inserted into the main body 200. As the handle 234 is raised, the lift 230 may push the sandwich out of the main body 200 to expose the sandwich.

The lifting surface 232 may lift the sandwich as the handle is raised. The lifting surface 232 may be horizontally oriented within the main body 200. The bottom of the lifting surface 232 may be coupled to the handle 234 such that vertical movement of the handle 234 results in vertical movement of the lifting surface 232. The lifting surface 232 may be narrower both laterally and front-to-rear than the main body 200 such that the lifting surface 232 may move vertically within the main body 200.

The handle 234 may be a horizontally oriented armature coupled to the bottom of the lifting surface 232. The handle may be longer than the width of the main body 200 such that the handle 234 projects from both the left side 206 and the right side 208 of the main body 200 via the handle slots 214.

The stand 240 may provide a base where the main body 200 may be rested while being maintained in a vertical orientation.

The stand 240 may comprise a bottom surface 246 which may be placed upon a horizontal surface that supports the stand 240. The stand 240 may comprise one or more holding pins 244 located on a top surface 242 of the stand 240. The one or more holding pins 244 may correspond to one or more stand apertures 218 that are located on the bottom of the bottom panel 210 of the main body 200. The main body 200 may be placed over the stand 240 and lowered such that the one or more holding pins 244 engage the one or more stand apertures 218 to retain the main body 200 in an upright orientation without being held.

Although the invention 100 has been described in a vertical orientation, the main body 200 may be reoriented without limitation during use. As a non-limiting example, the main body 200 may be moved to a horizontal orientation while biting the sandwich.

In use, a sandwich may be placed into a main body 200 by moving a handle 234 down and inserting the sandwich into the open top of the main body 200 until the sandwich rests on a lift 230. As a non-limiting example, the sandwich may be a hamburger. A front side 202 of the main body 200 and a rear side 204 of the main body 200 may press the sandwich together such that condiments and toppings are prevented from falling out of the sandwich. The main body 200 may be lifted from a stand 240 in order to eat the sandwich. The handle 234 may be pulled towards the top of the main body 200 to reposition the sandwich using a lifting surface 232. The main body 200 may be turned to the vertical orientation and placed back on the stand 240 at any time. Once the sandwich has been consumed, the lift 230 may be removed from the main body 200 by lifting the handle 234 until the lift 230 is aligned with removal apertures 216 and then sliding the lift 230 laterally through one of the removal apertures 216. The main body 200, the lift 230, and the stand may be cleaned separately and then reassembled.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" refers to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" is an opening in a surface. Aperture may be synonymous with hole, slit, crack, gap, slot, or opening.

As used in this disclosure, "concave" is used to describe a surface that resembles the interior surface of a sphere or a portion thereof.

As used in this disclosure, "convex" is used to describe a surface that resembles the exterior surface of a sphere or a portion thereof.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", refer to connecting, either directly or indirectly, and does not necessarily imply a mechanical connection.

As used in this disclosure, the word "exterior" is used as a relational term that implies that an object is not located or contained within the boundary of a structure or a space.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, the word "lateral" refers to the sides of an object or movement towards a side. Lateral directions are generally perpendicular to longitudinal directions. "Laterally" refers to movement in a lateral direction.

As used in this disclosure, "orientation" refers to the positioning and/or angular alignment of a first object relative to a second object or relative to a reference position or reference direction.

As used in this disclosure, a "slot" is a long narrow groove, cut, opening, or aperture that is formed in or through an object.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hamburger holder comprising:

a main body, a lift, and a stand;

wherein the hamburger holder holds a sandwich and prevents condiments and toppings from falling out of the sandwich as the sandwich is eaten;

wherein the main body, the lift, and the stand are decoupled from each other for cleaning;

wherein the main body comprises a front side, a rear side, and a bottom panel;

wherein the main body is an open-top container into which the sandwich is placed;

wherein the front side and the rear side apply pressure to the outer layers of the sandwich to prevent the sandwich from opening;

wherein a top edge of both the front side and the rear side comprise a scalloped upper edge to provide biting space.

2. The hamburger holder according to claim 1 wherein the front side and the rear side are vertically oriented and parallel to each other.

3. The hamburger holder according to claim 2 wherein the bottom portion of the front side and the rear side are each semicircular.

4. The hamburger holder according to claim 3 wherein the top portion of the front side has straight vertical edges that are parallel to each other;

wherein the top portion of the rear side has straight vertical edges that are parallel to each other.

5. The hamburger holder according to claim 4 wherein the bottom panel is a rectangular panel that curves upwards on each end and couples to the front side and to the rear side;

wherein the bottom panel is convex at the bottom exterior of the main body and concave at the bottom interior of the main body to conform to the shape of the front side and the rear side.

6. The hamburger holder according to claim 5 wherein the bottom panel extends straight upwards to form a left side and a right side of the main body.

7. The hamburger holder according to claim 6 wherein the curved section of the bottom panel is coupled to the semicircular section of the front side and the rear side.

8. The hamburger holder according to claim 7 wherein the left side is coupled to the left edge of the front side and to the left edge of the rear side;

wherein the right side is coupled to the right edge of the front side and to the right edge of the rear side.

9. The hamburger holder according to claim 8 wherein an individual side selected from the left side and the right side comprises a handle slot and a removal aperture;

wherein a handle of the lift passes through the handle slot.

10. The hamburger holder according to claim 9 wherein the handle slot and the removal aperture are contiguous such that the handle is elevated from the handle slot into the removal aperture.

11. The hamburger holder according to claim 10 wherein the lift is removed from the interior of the main body by passing the lift laterally through the removal aperture when the lift is elevated to align with the removal aperture.

12. The hamburger holder according to claim 11 wherein the lift comprises a lifting surface and the handle;

wherein the lift limits the distance into the main body that the sandwich is inserted.

13. The hamburger holder according to claim 12 wherein with the lift lowered such that the handle as located at the bottom of the handle slot on both the left side and the right side, the sandwich is maximally inserted into the main body;

wherein as the handle is raised, the lift pushes the sandwich out of the main body to expose the sandwich.

14. The hamburger holder according to claim 13 wherein the lifting surface lifts the sandwich as the handle is raised;

wherein the lifting surface is horizontally oriented within the main body;

wherein the bottom of the lifting surface is coupled to the handle such that vertical movement of the handle results in vertical movement of the lifting surface.

15. The hamburger holder according to claim 14 wherein the lifting surface is narrower both laterally and front-to-rear than the main body such that the lifting surface moves vertically within the main body.

16. The hamburger holder according to claim 15 wherein the handle is a horizontally oriented armature coupled to the bottom of the lifting surface.

17. The hamburger holder according to claim 16
wherein the handle is longer than the width of the main body such that the handle projects from both the left side and the right side of the main body via the handle slots.

18. The hamburger holder according to claim 17
wherein the stand provides a base where the main body rests while being maintained in a vertical orientation;
wherein the stand comprises a bottom surface which is placed upon a horizontal surface that supports the stand;
wherein the stand comprises one or more holding pins located on a top surface of the stand;
wherein the one or more holding pins correspond to one or more stand apertures that are located on the bottom of the bottom panel of the main body;
wherein the main body is placed over the stand and lowered such that the one or more holding pins engage the one or more stand apertures to retain the main body in an upright orientation without being held.

* * * * *